US010342280B2

(12) United States Patent
Valentino, Sr. et al.

(10) Patent No.: US 10,342,280 B2
(45) Date of Patent: Jul. 9, 2019

(54) PROTECTIVE HELMET

(71) Applicant: Diffusion Technology Research, LLC, McLean, VA (US)

(72) Inventors: Joseph A. Valentino, Sr., Media, PA (US); Bruce H. Dewoolfson, Jr., Vienna, VA (US)

(73) Assignee: Diffusion Technology Research, LLC, McLean, VA (US)

( * ) Notice: Subject to any disclaimer, the term of this patent is extended or adjusted under 35 U.S.C. 154(b) by 0 days.

(21) Appl. No.: 16/131,087

(22) Filed: Sep. 14, 2018

(65) Prior Publication Data

US 2019/0159542 A1 May 30, 2019

Related U.S. Application Data

(63) Continuation-in-part of application No. 15/827,689, filed on Nov. 30, 2017.

(51) Int. Cl.

| | |
|---|---|
| ***A42B 3/06*** | (2006.01) |
| ***A42B 3/12*** | (2006.01) |
| *A42C 5/04* | (2006.01) |

(52) U.S. Cl.

CPC ..... *A42B 3/064* (2013.01); *A42B 3/125* (2013.01); *A42C 5/04* (2013.01)

(58) Field of Classification Search

CPC ..... A42B 3/064; A42B 3/125; A42B 3/06; A42B 3/063; A42C 5/04

See application file for complete search history.

(56) References Cited

U.S. PATENT DOCUMENTS

| | | | | |
|---|---|---|---|---|
| 4,209,858 | A * | 7/1980 | Coenen | A42B 3/06 2/10 |
| 4,307,471 | A * | 12/1981 | Lovell | A42B 3/065 2/411 |
| 4,345,338 | A * | 8/1982 | Frieder, Jr. | A42C 2/007 2/414 |
| 5,351,342 | A * | 10/1994 | Garneau | A42B 3/066 2/414 |
| 6,260,212 | B1 * | 7/2001 | Orotelli | A42B 3/06 2/410 |
| 8,756,719 | B2 * | 6/2014 | Veazie | A42B 3/121 2/411 |
| 10,010,126 | B1 * | 7/2018 | Shaffer | A42B 3/064 |
| 2001/0032351 | A1 * | 10/2001 | Nakayama | A42B 3/064 2/412 |

(Continued)

*Primary Examiner* — Shaun R Hurley
*Assistant Examiner* — Bao-Thieu L Nguyen
(74) *Attorney, Agent, or Firm* — Finnegan, Henderson, Farabow, Garrett & Dunner LLP

(57) ABSTRACT

A protective helmet. The protective helmet includes an outer layer and an inner layer, each formed of a hard material. The outer layer and the inner layer each further include a concave interior surface and a convex exterior surface. A flexible connector connects the concave interior surface of the outer layer to the convex exterior surface of the inner layer. The flexible connector is configured to allow the outer layer to laterally shift relative to the inner layer upon impact to the protective helmet. Upon impact, the convex surface moves along the inclined planed of the concave surface in a direction opposite of the impact, while the stretched flexible connector provides a restoring force pulling the inner and outer layers back to their original positions.

11 Claims, 14 Drawing Sheets

(56) References Cited

U.S. PATENT DOCUMENTS

2003/0140400 A1* 7/2003 Ho ..... A42B 3/063 2/411
2006/0137073 A1* 6/2006 Crisco ..... A42B 3/063 2/142
2009/0260133 A1* 10/2009 Del Rosario ..... A42B 3/062 2/412
2010/0299812 A1* 12/2010 Maddux ..... A41D 13/0156 2/414
2010/0319110 A1* 12/2010 Preston-Powers ..... A42B 3/285 2/422
2012/0180199 A1* 7/2012 Chilson ..... A42B 3/283 2/411
2012/0198604 A1* 8/2012 Weber ..... A42B 3/125 2/414
2013/0042397 A1* 2/2013 Halldin ..... A42B 3/064 2/411
2014/0013491 A1* 1/2014 Hoshizaki ..... A42B 3/064 2/411
2014/0173810 A1* 6/2014 Suddaby ..... A42B 3/124 2/413
2014/0208486 A1* 7/2014 Krueger ..... A42B 3/064 2/414
2015/0089722 A1* 4/2015 Berry ..... A42B 3/064 2/412
2015/0089724 A1* 4/2015 Berry ..... A42B 3/064 2/414
2015/0359285 A1* 12/2015 Rennaker, II ..... A42B 3/064 2/414
2016/0088884 A1* 3/2016 Guerra ..... A42B 3/064 2/411
2016/0316847 A1* 11/2016 Weber ..... A42B 3/125
2016/0338440 A1* 11/2016 Popejoy ..... A42B 3/0473
2017/0105470 A1* 4/2017 Eaton ..... A42B 3/064
2017/0290389 A1* 10/2017 Copeland ..... A42B 3/0406
2017/0303612 A1* 10/2017 Morgan ..... A41D 31/005
2017/0303622 A1* 10/2017 Stone ..... A42B 3/064
2017/0340045 A1* 11/2017 Pickett ..... A42B 3/061
2017/0360139 A1* 12/2017 Aguilera Robles ..... A42B 3/04
2018/0271198 A1* 9/2018 Ku ..... A42B 3/064

* cited by examiner

PROTECTIVE HELMET

CROSS-REFERENCE TO RELATED APPLICATIONS

This application is a continuation-in-part of U.S. patent application Ser. No. 15/827,689, filed Nov. 30, 2017 and titled "Protective Helmet," the entirety of which is incorporated herein by reference.

BACKGROUND OF THE INVENTION

The present disclosure relates to all types of helmets and, more particularly, to a helmet that protects a wearer from concussions.

Head trauma resulting from sports and other activities is a common occurrence. Generally, head trauma occurs when an object impacts the head, thereby transferring energy to the head. A common head trauma resulting from sports is a concussion, which occurs when the brain bangs inside the skull and is bruised. To reduce the incidence of skull fracture and concussion, it is common practice to wear a protective helmet. Protective helmets are ostensibly designed to deflect and absorb energy transmitted by impact to the helmet, thereby diminishing the risk of head fracture and brain injury resulting from the impact.

Protective athletic helmets have been worn for almost a century, and have evolved from sewn leather, to helmets having molded plastic outer shells with suspension webbing or other head fitting structures such as foam pads, air bladders, or padded molding on their interior. Despite the evolution of the protective helmets, the reported rate of concussions has been increasing amongst students and professional athletes in many sports and other activities While some experts have attributed this increase to better reporting and diagnosis, other experts have attributed the increase to increased forces generated as competitive athletes continue to increase in size (mass) and increase their ability to accelerate.

As can be seen, there is a need for an improved helmet that reduces the risk of concussions due to impact.

SUMMARY

Disclosed embodiments include, a protective helmet that may include: an outer layer and an inner layer each formed of a hard material and each including a concave interior surface and a convex exterior surface; at least one flexible connector connecting the concave interior surface of the outer layer to the convex exterior surface of the inner layer, where the at least one flexible connector is configured to allow the outer layer to laterally shift relative to the inner layer upon impact to the protective helmet.

In another disclosed embodiment, a protective helmet may include: an outer layer and an inner layer each formed of a hard material and each including a concave interior surface and a convex exterior surface; at least one flexible connector connecting the concave interior surface of the outer layer to the convex exterior surface of the inner layer, a receptacle coupled to one of the concave interior surface of the outer layer and the convex exterior surface of the inner layer; and a protrusion coupled to the other of the concave interior surface of the outer layer and the convex exterior surface of the inner layer, where the at least one flexible connector is configured to allow the outer layer to laterally shift relative to the inner layer upon impact to the protective helmet, and the protrusion is disposed within the receptacle, and laterally shifts within the receptacle upon the impact to the protective helmet.

It is to be understood that both the foregoing general description and the following detailed description are exemplary and explanatory only, and are not restrictive of the disclosed embodiments.

BRIEF DESCRIPTION OF THE DRAWINGS

The accompanying drawings, which are incorporated in and constitute a part of this specification, illustrate several embodiments and, together with the description, serve to explain the disclosed principles. In the drawings.

DETAILED DESCRIPTION OF THE INVENTION

Figure 1:
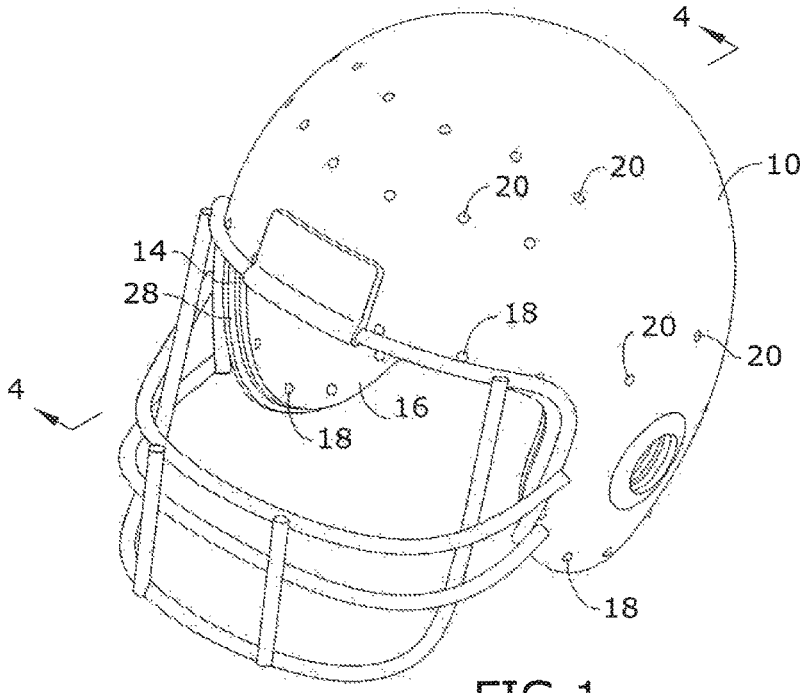
FIG. 1 is a top perspective view of a helmet consistent with disclosed embodiments.
Figure 2:
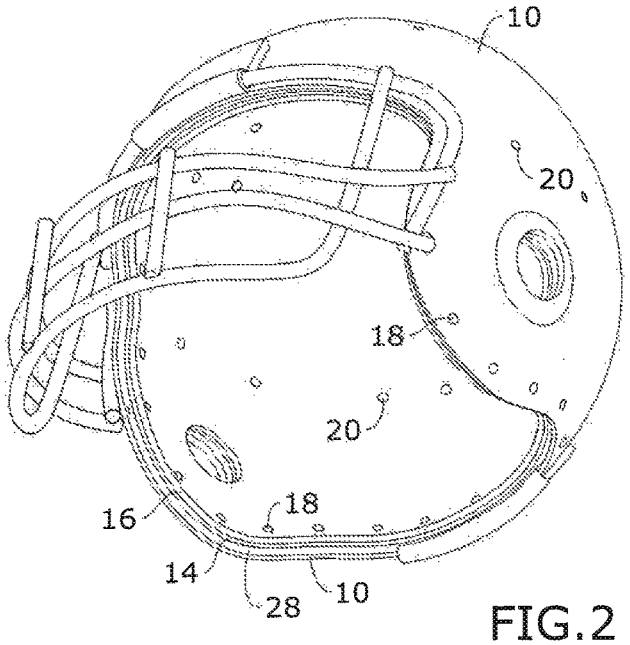
FIG. 2 is a bottom perspective view of a helmet consistent with disclosed embodiments.
Figure 3:
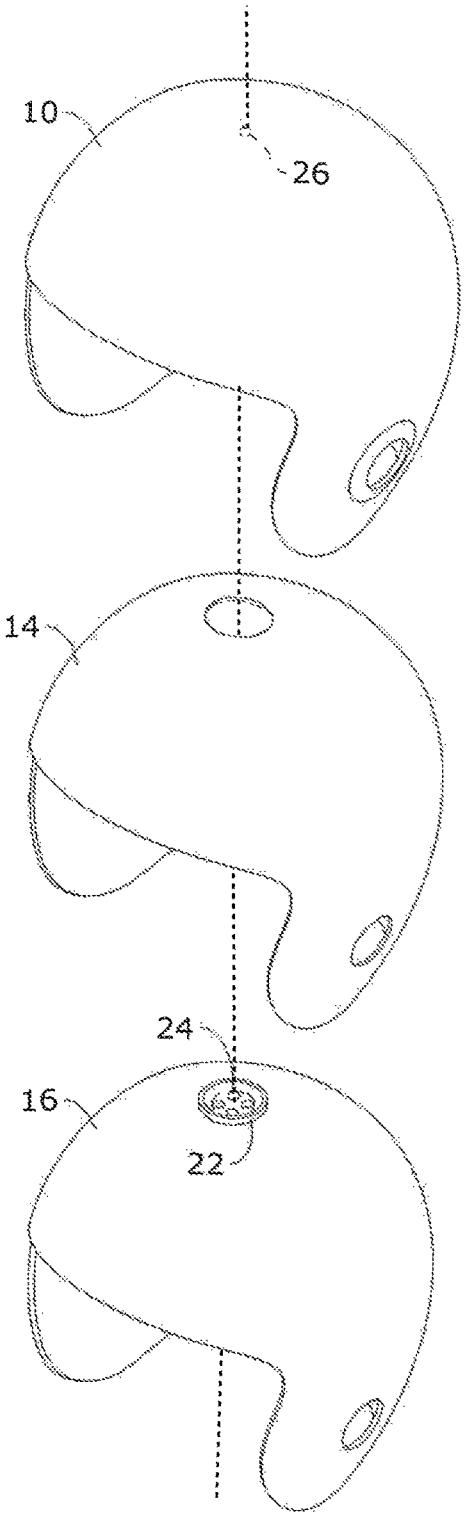
FIG. 3 is an exploded perspective view of helmet layers consistent with disclosed embodiments.
Figure 4:
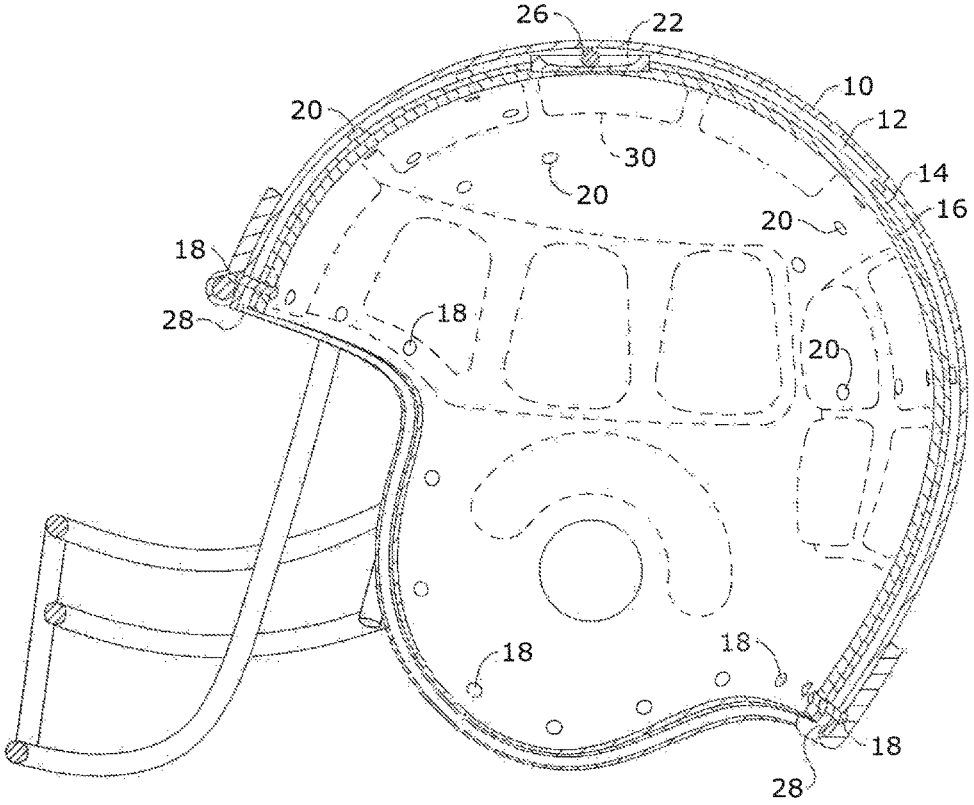
FIG. 4 is a section view a helmet, taken along line 4-4 in FIG. 1, consistent with disclosed embodiments.
Figure 5:
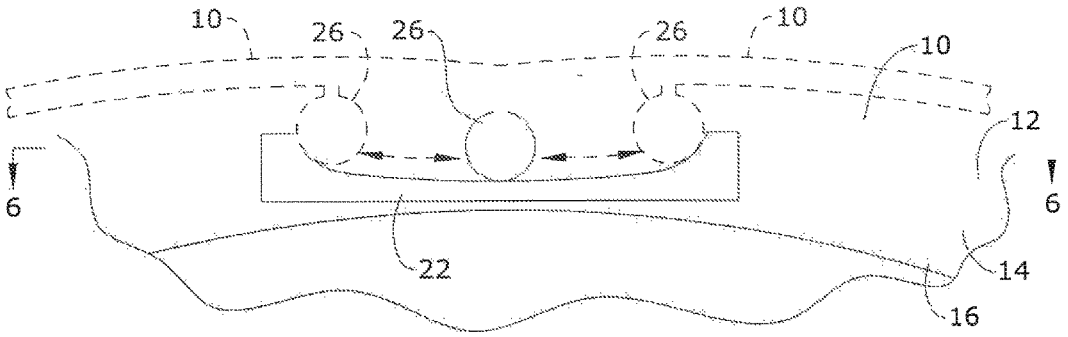
FIG. 5 is a detail section view of an embodiment of a helmet illustrating movement of a ball within a bowl, consistent with disclosed embodiments.
Figure 6:
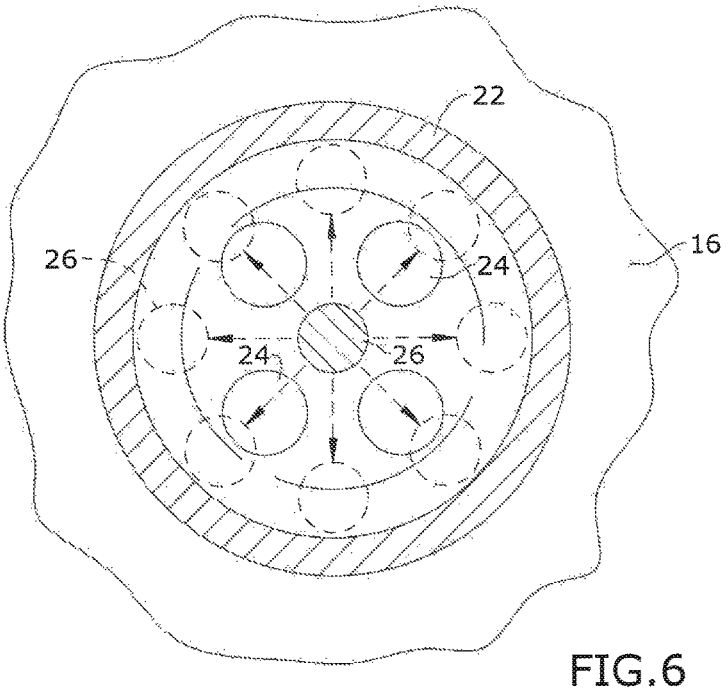
FIG. 6 is a detail section view of a helmet, taken along line 6-6 in FIG. 5 illustrating movement of a ball within a bowl, consistent with disclosed embodiments.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Disclosed embodiments describe a helmet that reduces impact forces to a user's head. In some embodiments, the helmet may further prevent concussions from happening. In certain embodiments, the helmet includes an inner and an outer shell. The shells may be mounted together by spring loads and/or compression mounts. Some embodiments further include an inclined plane bowl-shaped receptacle disposed between the shells, and a rounded protrusion disposed within the inclined plane bowl shaped receptacle. The components of the helmet may convert energy exerted on the outer helmet into a push/pull energy between the shells, thereby diffusing the energy before it reaches the inner shell and the users head. Further, the inclined plane of the bowl may cause a deceleration of the impact, with tension between the inner and outer shells. The space between the two shells can be filled with additional padding for added protection to the user such that the inner and outer shells are able to move relative to each other without interference.

Referring to FIGS. 1 through 6, the disclosed embodiments include a protective helmet having an outer layer 10 and an inner layer 16 each formed of a hard material. The outer layer 10 and the inner layer 16 may each further include a concave interior surface and a convex exterior surface. Air vents 28 may be formed through the outer layer 10 and the inner layer 16. A flexible connector 18 may connected the concave interior surface of the outer layer 10 to the convex exterior surface of the inner layer 16. The flexible connector 18 may be configured to allow the outer layer 10 to laterally shift relative to the inner layer 16 upon impact to the protective helmet.

Some embodiments may include a receptacle 22 and a protrusion 26. The receptacle 22 and the protrusion 26 may be secured to a central portion of the helmet. The receptacle 22 may include a bottom side and a top side. The bottom side may be coupled to one of the concave interior surface of the outer layer 10 and the convex exterior surface of the inner layer 16. As illustrated in the Figures, the bottom side may be coupled to the convex exterior surface of the inner layer 16 by rivets 24 or other fasteners. The top side of the receptacle 22 may include an inner surface that forms the receptacle. In some embodiments, the protrusion and receptacle may be molded into the inner and outer layers of the helmet, respectively. The inner surface may include an inclined plane running from a central axis to an upper edge. For example, the inner surface may be bowl-shape, concave shape, conical shape, frusta-conical shape and the like. The protrusion 26 may be coupled to the other of the concave interior surface of the outer layer 10 and the convex exterior surface of the inner layer 16. As illustrated in the Figures, the protrusion 26 may be coupled to the concave interior surface of the outer layer 10. An outer surface of the protrusion 26 may be a mirror image of the inner surface of the of the receptacle 22. For example, the outer surface of the protrusion 26 may be rounded, ball shaped, wedge shaped, a conical shape, a frusto-conical shape and the like. The flexible connector 18 may bias the protrusion 26 to rest within the central axis of the receptacle 22.

When a force is exerted on the protective outer shell due to impact, the flexible connector 18 may deform and the outer layer 10 may laterally shift relative to the inner layer 16. Due to the shifting between layers 10, 16, the protrusion 26 shifts within the bowl-shaped receptacle 22 and travels up the inclined plane, which dissipates and/or diffuses energy as the layers 10, 16 are pushed away from one another. After the impact, the flexible connector 18 recovers and the protrusion 26 shifts back to the central axis of the receptacle 22.

The flexible connector 18 may include a plurality of flexible pegs connecting the outer layer 10 to the inner layer 16. The plurality of flexible pegs may be evenly spaced apart about the perimeter of the outer layer 10 and the inner layer 16. A gap 12 may be formed between the outer layer 10 and the inner layer 16 due to the flexible pegs 18 separating the outer layer 10 from the inner layer 16. The flexible pegs 18 may include a rubber elasticity. For example, the flexible pegs 18 may be formed of a rubber. In some embodiments, the rubber may have a Young's modulus, for example, between 0 and 50 on the Shore D Durometer scale.

The protective helmet may further include additional padding. For example, some embodiments may include a plurality of compression mounts 20 secured to one of the concave interior surface of the outer layer 10 and the convex exterior surface of the inner layer 16. The compression mounts 20 may be made of a material having rubber elasticity and may absorb additional force from the impact.

Some embodiments may further include an intermediary layer 14 formed of a foam padding material. The intermediary layer 14 may be disposed between the outer layer 10 and the inner layer 16. For example, the intermediary layer 14 may be adhered to the convex exterior surface of the inner layer 16. The intermediary layer 14 may be made of foam. The foam may be an elastomeric, cellular (including microcellular) foam or any other desirable foam. The intermediary layer 14 may be made of a soft resilient thermoplastic polyurethane (TPU) (i.e., having a Shore hardness considerably below the Shore hardness of the hard material). In another embodiment, the intermediary layer 14 is made of open-cell polyurethane. In another embodiment, intermediary layer 14 is made of closed cell polyolefin foam. In another embodiment, the intermediary layer 14 is made of polyethylene foam which may be a high- or low-density polyethylene foam.

In certain embodiments, the helmet may include a plurality of cushioning pads 30 attached to the concave interior surface of the inner layer 16. The cushioning pads 30 may be made of foam. The foam may be an elastomeric, cellular (including microcellular) foam or any other desirable foam. In another embodiment, the cushioning pads 30 are made of a soft resilient thermoplastic polyurethane (TPU). In another embodiment, cushioning pads 30 are made of an open-cell polyurethane. In another embodiment, the cushioning pads 30 are made of a closed cell polyolefin foam. In another embodiment, the cushioning pads 30 are made of a polyethylene foam which may be a high- or low-density polyethylene foam.

The hard material may be considerably harder than the flexible connectors 18, the intermediary layer 14 and the cushioning pads 30. In one embodiment, the hard layers 10, 16 are made of a polycarbonate shell. In another embodiment, the hard layers 10, 16 are made of a different hard plastic such a polypropylene. In another embodiment, the hard layers 10, 16 are made of ABS resin. In another embodiment, the hard layers 10, 16 are made of carbon fiber or fiberglass. In another embodiment, the hard layers 10, 16 are made of a polypropylene which is considerably harder than the materials intermediary layer 14 and the flexible connectors 18. Generally, the hardness of the hard layers 10, 16 structure may be characterized by a hardness on the Shore D Durometer scale (typically Shore D 75 and over).

Figure 7A:
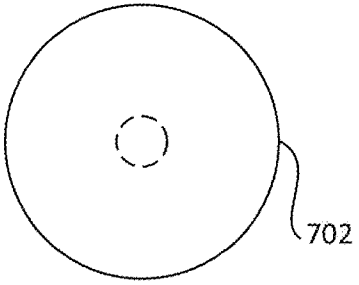
FIGS. 7A and 7B are illustrations of a convex member and concave member, consistent with disclosed embodiments.
Figure 7B:
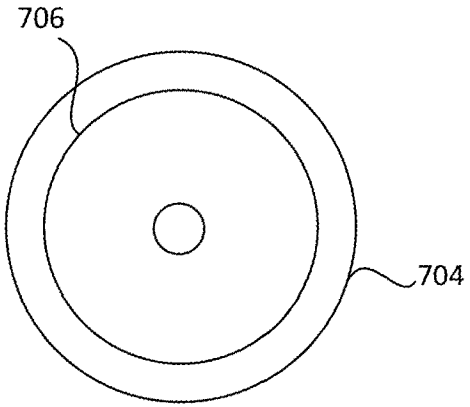

FIG. 7A is a top-down view of a convex member 702 and FIG. 7B is a top-down view of a concave member 704. Convex member 702 may include a convex surface 703 and a surface 705, shown in FIG. 8. Convex surface 703 may be conical or frusto-conical and may be configured to fit into a space defined by a surface 706 of concave member 704. Concave member 704 may include a concave surface 706 defining a space having the same geometry of convex surface 703 and may include a base surface 714. In some embodiments, as described with reference to FIGS. 1-6, convex member 702 may have a different geometry than surface 706 of concave member 704.

Figure 8:
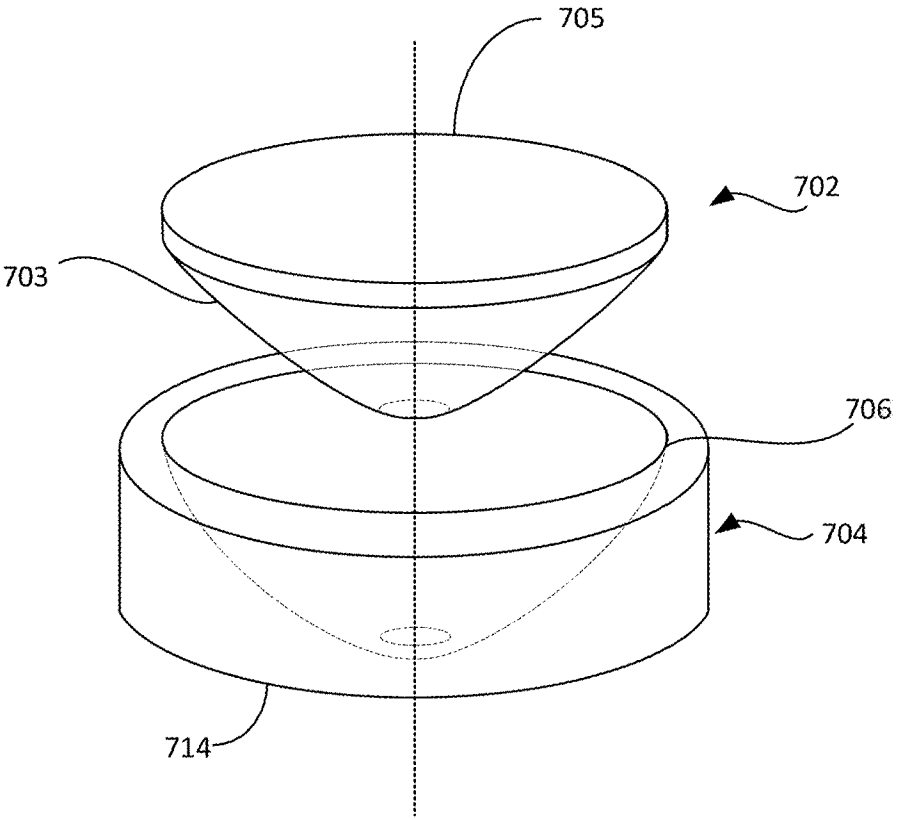
FIG. 8 is an illustration of a convex member and concave member, consistent with disclosed embodiments.

FIG. 8 is a perspective view of convex member 702 and concave member 704. The surface 706 may be concave or may be an inclined plane such that convex member 702 may slide laterally against surface 706. In some embodiments, the concave and convex members may have, for example, a diameter of 2.5 in. In some embodiments, the convex and concave members may have different diameters. The height of the each of the concave member 704 and convex member 702 may vary based on the desired incline of surface 706. In some embodiments, convex member 702 and concave member 704 may have equal heights. In other embodiments, the height of convex member 702 may be greater than or less than the height of concave member 704.

Figure 9B:
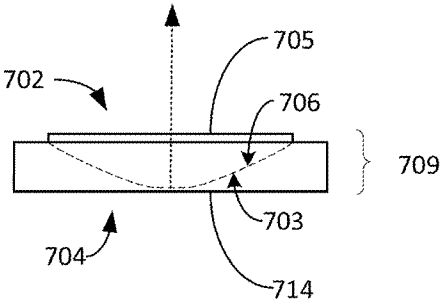
FIGS. 9A and 9B are illustrations of example configurations of a convex member and concave member, consistent with disclosed embodiments.
Figure 9A:
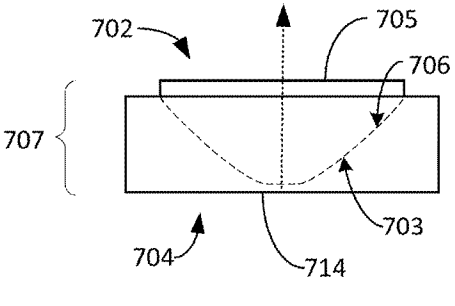

FIGS. 9A and 9B illustrate two exemplary assemblies 707 and 709, respectively. Each assembly includes a convex member 702 nested in a concave member 704. Assembly 707 includes a concave surface 706 having an incline of 45 degrees relative to a central axis normal to assembly 707. Assembly 709 includes a concave surface 706 having an incline of 30 degrees relative to the central axis. In some embodiments, the assembly 709 may have an incline of 25 degrees or greater. The depth and geometry of the concave surface 706 and the geometry and height of convex surface 703 may vary depending on the helmet's intended use or required specifications. For example, assembly 707 may prevent a larger amount of relative displacement between the inner and outer layers (e.g., layers 10 and 16 as described with reference to FIGS. 1-6) of the helmet than assembly 709 because the concave surface 706 of assembly 707 has a greater incline and greater depth than concave surface 706 of assembly 709. Thus, for assembly 707, the amount of energy required to shift the convex member 702 relative to the concave member 704 is greater than the amount of energy required to shift the convex member 702 and concave member 704 of assembly 709. Analogously, a smaller amount of force would be required to displace convex member 702 nested in concave member 704. Exemplary inclines of surface 706 may be 25 degrees or greater, for example, 30 degrees, 45 degrees, 60 degrees, etc. In some embodiments, the degree of incline is symmetric about the central axis of the convex and concave members.

Figure 10:
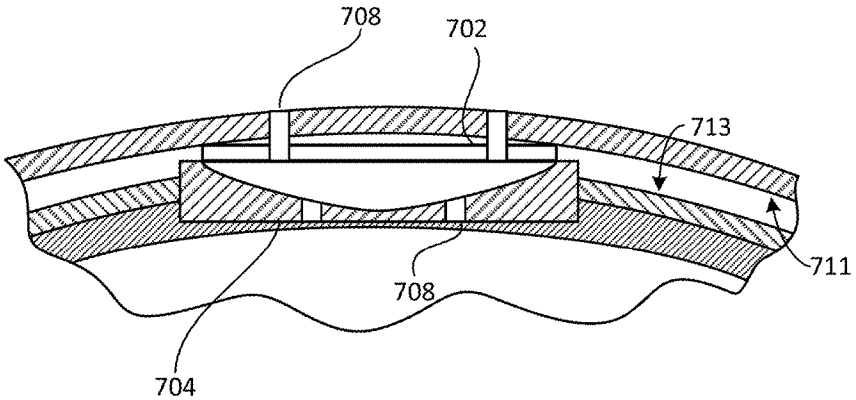
FIG. 10 is a cutaway illustration of a convex member and concave member in a helmet, consistent with disclosed embodiments.
Figure 11A:
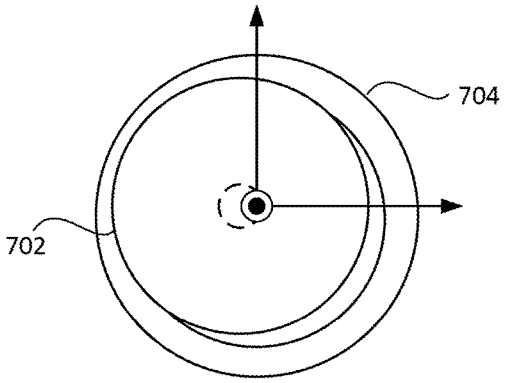
FIGS. 11A-11D are illustrations of displacement of a convex member within a concave member, consistent with disclosed embodiments.
Figure 11B:
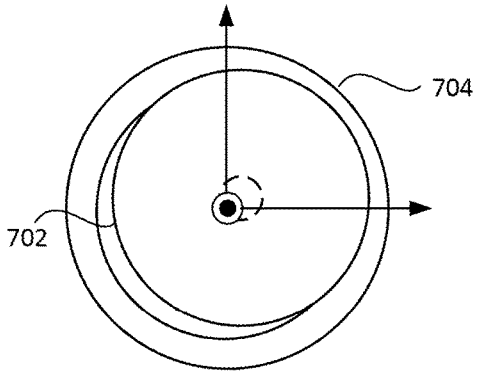
Figure 11C:
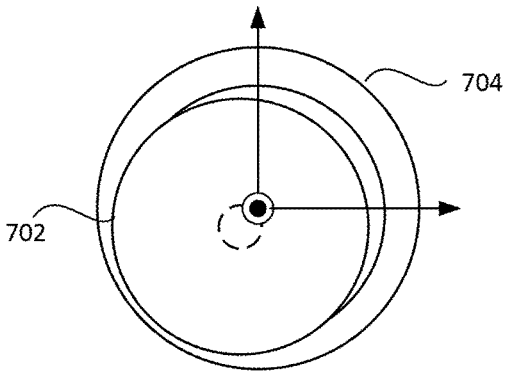
Figure 11D:
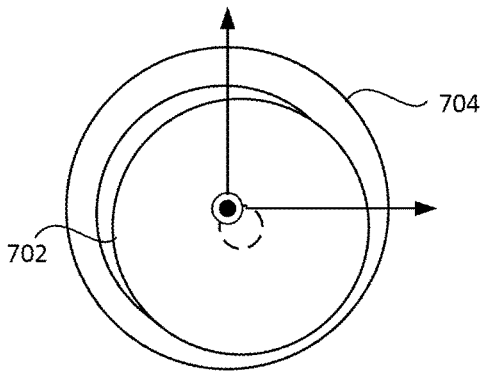

FIG. 10 illustrates the convex member 702 nested in concave member 704 in an exemplary helmet, such as that described with reference to FIG. 1. In some embodiments, surface 705 may be disposed proximate an inner surface 711 of an outer layer (e.g., layer 10, depicted in FIG. 1). Convex member 702 may be joined to the outer layer of the helmet with screws disposed in bore holes 708, which are parallel to a central axis of the convex member 702 passing through the outer layer and surface 705 of convex member 702. In some embodiments, surface 705 may be flat. In other embodiments, the surface 705 may be configured to have the same curvature as the inner surface 711 of the outer layer. Base surface 714 may be disposed proximate an outer surface 713 of an inner layer (e.g., layer 16, depicted in FIG. 1) of a helmet. Concave member 704 may be joined to the inner layer with one or more screws disposed in one or more bore holes 708 parallel to the central axis of concave member 704 passing through the inner layer of the helmet and base surface 714. In other embodiments, either one or both of convex member 702 and concave member 704 may be joined to the outer and inner layers, respectively, by any means known to a person of ordinary skill in the art. For example, surface 705 and base surface 714 may be configured to snap-fit into cutaway portions of the outer and inner layers, respectively. In some embodiments, one or both of convex member 702 and concave member 704 sit within a cutaway portion of the outer and inner layers, respectively, to decrease the overall thickness of the helmet. In other embodiments, concave member 704 may be fixedly joined to the inner layer and convex member 702 may be fixedly joined to the outer layer.

Figure 13B:
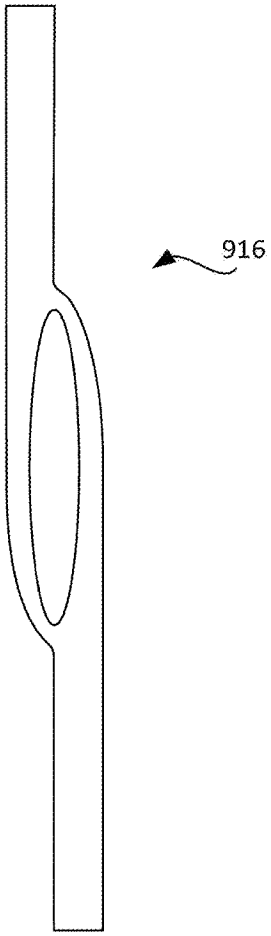
FIGS. 13A-13C are illustrations of an elastomeric strip, consistent with disclosed embodiments.

FIGS. 11A-11D illustrate exemplary displacements of convex member 702 about a central axis. Convex member 702 may have a 360-degree range of motion about the central axis of concave member 704. For example, when an impact occurs at a point on the outer layer of the helmet, the convex member 702 may laterally shift within concave member 704. As the convex member 702 moves laterally, the incline of surface 706 forces the convex member 702 and outer layer to move away from the inner layer along the central axis. Thus, rather than the energy of the impact being transferred to the inner layer and then to the wearer of the helmet, the energy is translated to a displacement of the outer layer relative to the inner layer. Unlike conventional helmets that use materials such as foam, struts, padding, or the like, to absorb the energy of the impact, the nested convex and concave members diffuse the energy of an impact. In the case of a forceful impact, instead of transferring energy to the wearer, disclosed embodiments translate the energy to displace the convex member. As the force of the impact increases, the distance between the inner and outer components increases, which generates a greater restoring force from one or more elastomeric components (described below with reference to FIGS. 13A-13C) configured to join the outer layer and inner layer of the helmet, which increases as the amount by which the elastomeric components are stretched. Therefore, the energy of the impact is diffused into the pushing apart of the components due to the relative movement of the convex and concave members and the pull of the elastomeric components in response to being stretched by the relative movement of the inner and outer components.

Figure 12A:
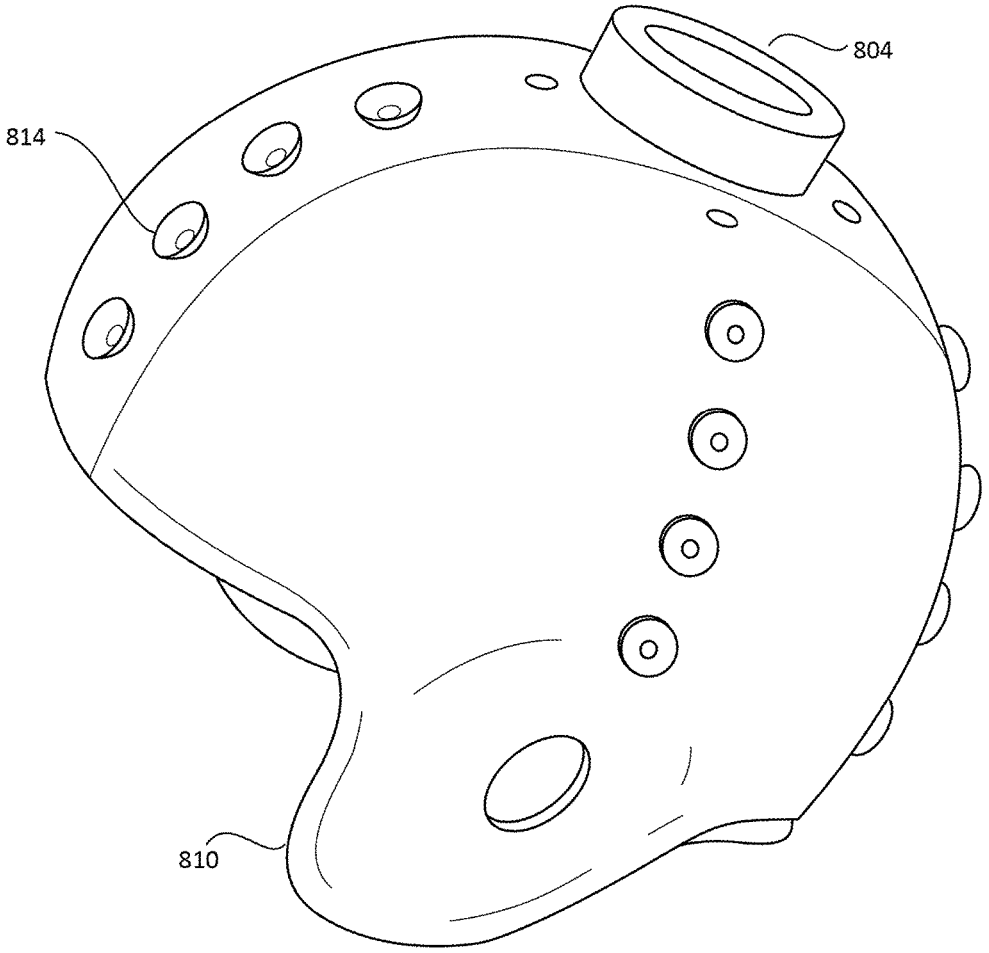
FIGS. 12A-12C are illustrations of an inner component of a helmet, consistent with disclosed embodiments.
Figure 12B:
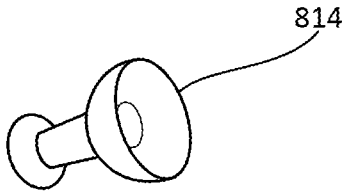
Figure 12C:
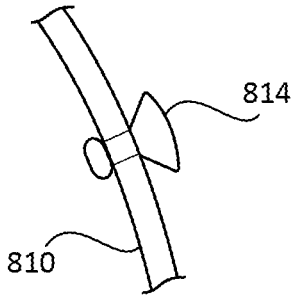

FIG. 12A is another exemplary embodiment of an inner component 810 of a helmet. In this embodiment, a plurality of compression mounts 814 are joined to inner component 810. Each compression mount 814 (shown in FIG. 12B) may be formed of an elastomeric material. The elastomeric material may be, for example, a soft, resilient thermoplastic material. The compression mounts 814 may be joined to the inner component 810, for example, by being snapped into a hole in inner component 810, as shown in FIG. 12C. The inner surface of the outer shell (e.g., layer 10) may rest on the cupped portions of the compression mounts 814 such that the compression mounts 814 may be free to move along the inner surface of the outer shell. Each compression mount 814 may have a height equal to that of concave member 804. In some embodiments, the height of each compression mount 814 may be less than or greater than the height of concave member 804. The number and placement of compression mounts 814 may vary based on the intended use or required specifications of the helmet.

Figure 13A:
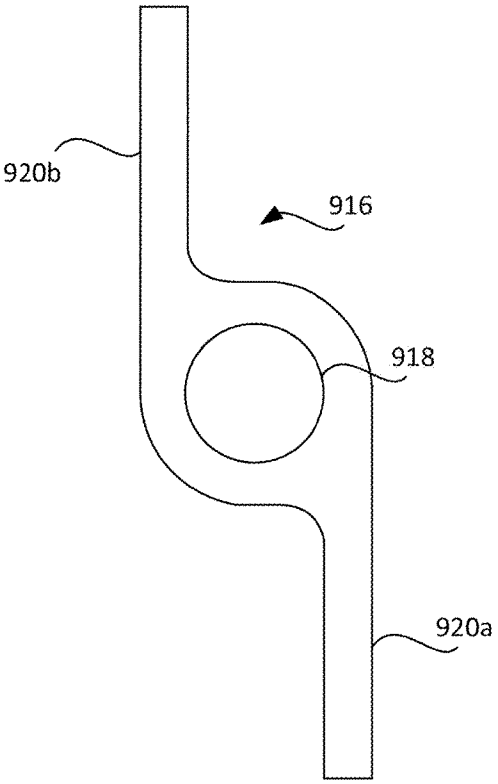
Figure 13C:
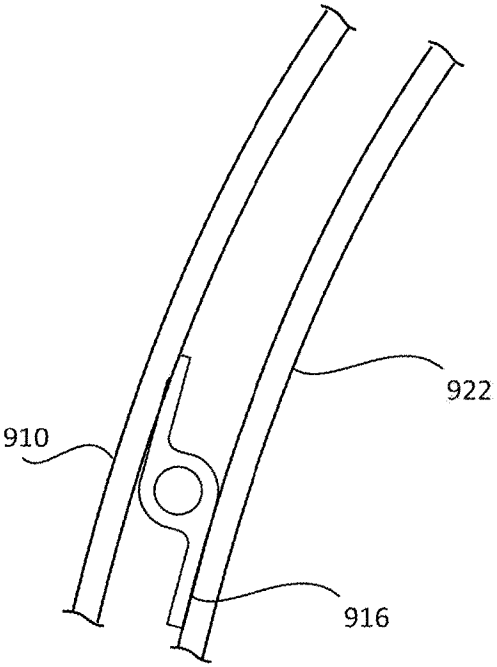

FIG. 13A is an illustration of a connector strip 916. Connector strip 916 may form a central cavity 918 and may have two wings 920*a*, 920*b* extending tangentially from the central cavity of the strip 918. Connector strip 916 may join the inner and outer components of the helmet as shown in FIG. 13C. For example, wing 920*a* may be fixedly joined to the inner component and wing 920*b* may be fixedly joined to the outer helmet. Connector strip 916 may be formed of an elastomeric material, e.g., rubber.

Upon impact to the outer component of the helmet and subsequent displacement of the outer component relative to the inner component, the connector strip 916 may stretch (shown in FIG. 13B) between the components and may pull the respective components back into their respective original positions. The material of strip 916 may vary based on the intended use or required specifications of the helmet.

Figure 14:
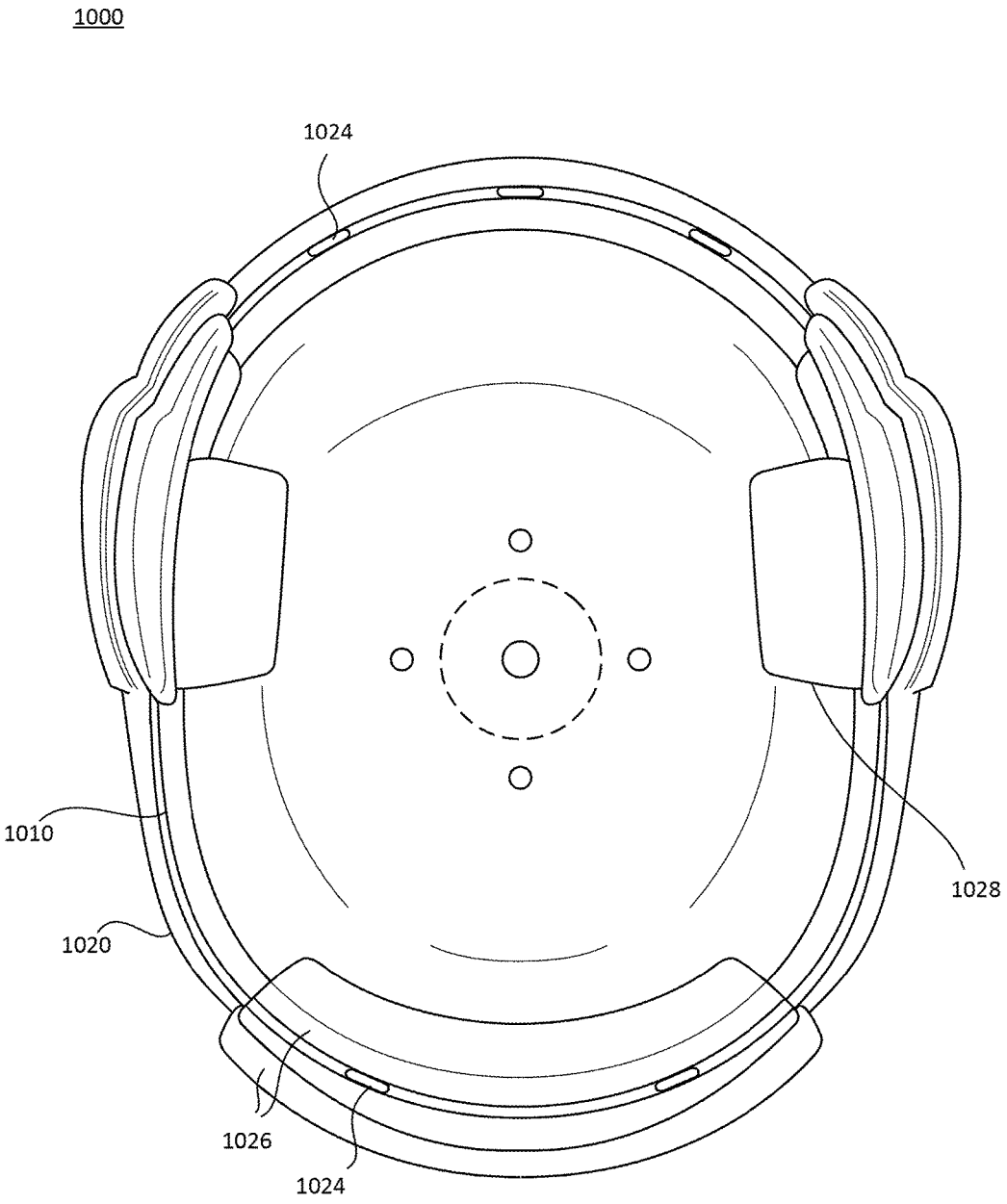
FIG. 14 is an illustration of a helmet, consistent with disclosed embodiments.

FIG. 14 is a bottom-up view of an exemplary helmet 1000 having one or more springs 1024 configured to supply a restoring force upon impact. In some embodiments, helmet 1000 may include any combination of springs, connector strips, and flexible connectors, which will be described with reference to FIGS. 15A-15B. Helmet 1000 may include an inner component 1010 and outer component 1022. Inner and outer components 1010, 1022 may be formed of a hard material, e.g., hard plastic, fiberglass, or carbon fiber. In some embodiments, the inner component 1010 and outer component 1022 are formed of different materials. Inner component 1010 and outer component 1022 may be held in position relative to each other by one or more conical springs 1024. Conical springs 1024 may be joined at a wider end to the inner surface of the outer component 1022 and may be joined at a narrower end to the outer surface of inner component 1010. In some embodiments, springs 1024 may be variable rate springs. In some embodiments, helmet 1000 may include any combination of front (not shown), back 1026, or side 1028 padding to provide additional comfort and protection to the wearer. The front, back 1026, and side 1028 padding may be disposed on either one or both of inner component 1010 or outer component 1022.

Figure 15A:
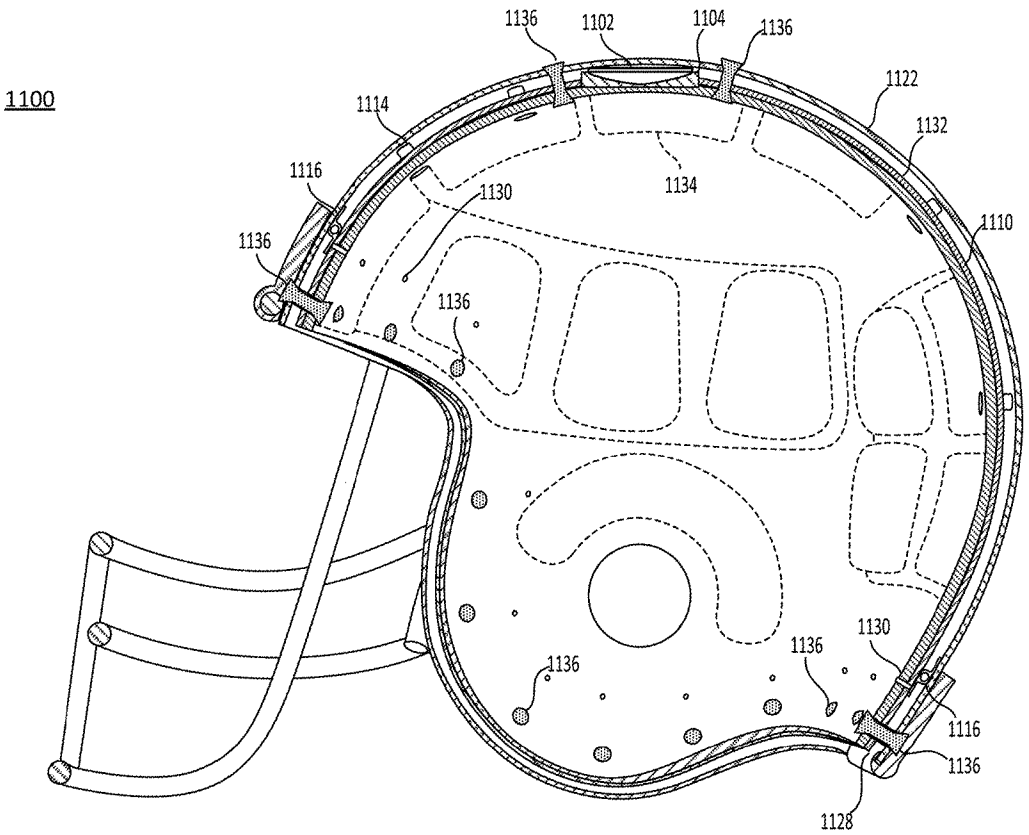
FIG. 15A is an illustration of a helmet, consistent with disclosed embodiments.

FIG. 15A is a side view of another exemplary helmet 1100 including a connector strip 1116 and flexible connectors 1136 (described below with reference to FIG. 15B). In some embodiments, helmet 1000 may include one or more connectors 1116. Outer component 1122 is disposed over inner component 1110. In some embodiments, connector strip 1116 may be disposed around the edges of the inner and outer components 1110 and 1122 in the gap 1128 formed between the inner surface of the outer component 1122 and the outer surface of the inner component 1110. Connector strip 1116 may be joined by each wing, 920*a*, 920*b*, of the connector strip 1116 to each respective component with fasteners 1130. For example, the connector strip 1116 may be fixedly joined to the inner and outer components by snap-fitting a plurality of connectors 1130 through one or more holes in each wing of the connector and in the inner and outer components of the helmet, respectively. In other embodiments, the wings 920*a*, 920*b* of connector strip 1116 may be joined to the inner 1110 and outer 1122 components respectively using an adhesive, rubber glue, or other fastening method. Connector strip 1116 may be formed of an elastomeric material, e.g., rubber, or may be springs (as shown in FIG. 14). Helmet 1100 may further include a plurality of compression mounts 1114 snapped into the inner component 1110, such as compression mounts 814, described with reference to FIGS. 12A-12C.

Figure 15B:
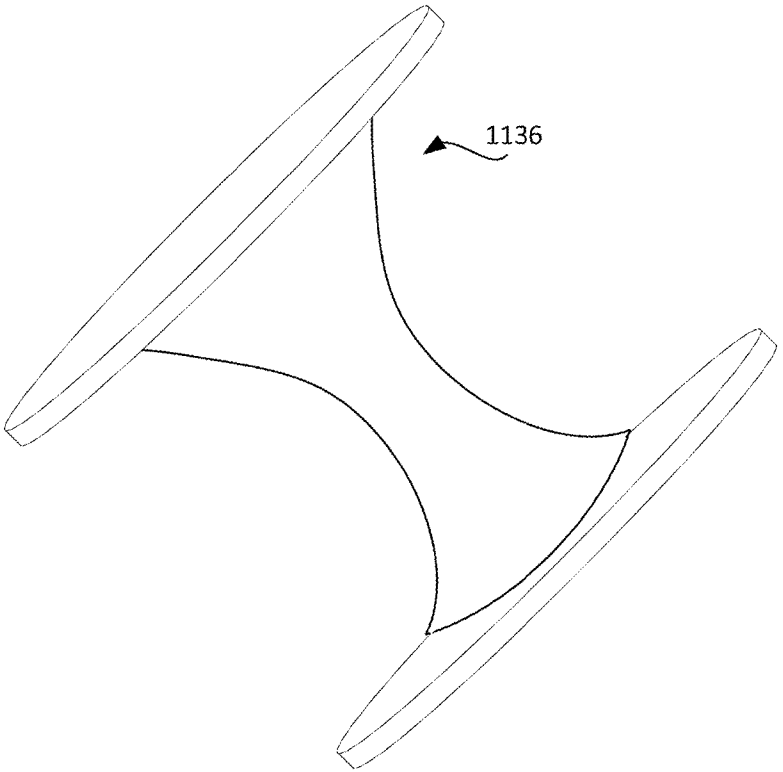
FIG. 15B is an illustration of a flexible connector, consistent with disclosed embodiments.

FIG. 15B is an exemplary flexible connector 1136. Flexible connector 1136 may be the same as flexible pegs 18 described with reference to FIG. 1. Flexible connector 1136 may be snap-fit into a bore hole in each of the inner and outer components, thereby connection the inner and outer components. Other geometries of flexible connector 1136 may be used such that each end of connector 1136 is configured to join securely to each of inner component 1110 and outer component 1122, respectively. Flexible connector 1136 may be formed of, for example, an elastomer, and may be configured to provide and elastic restoring force when stretched. Helmet 1100 may include a number of flexible connectors 1136 in any distribution or configuration. In other embodiments, flexible connectors 1136 may be springs, e.g., springs 1024 as shown in FIG. 14. In some embodiments, the ends of the flexible connectors may be joined to the inner and outer components of the helmet 1100 with an adhesive.

Referring again to FIG. 15A, in some embodiments, the outer surface of inner component 1110 may further include one or more foam strips 1132 to further absorb energy from an impact. The inner surface of inner component 1110 may include one or more areas of foam padding 1134 to provide additional protection to the wearer.

Concave member 1104 and convex member 1102 may be joined to the inner 1110 and outer 1122 components, respectively. When helmet 1100 receives an impact to the outer surface of outer component 1122, the inclined plane of concave member 1104 causes the convex member 1102 to move vertically up the surface (e.g., surface 706) of the concave member 1104. Depending on the direction of impact, portions of the outer component 1122 may move away from inner component 1110 while other portions move toward inner component 1110. The separation of the two components results in a stretching of the connector strip 1116 and flexible connector 1136. Thus, regardless of the direction of the impact, the convex member 1102 may shift with respect to concave member 1104 over a 360-degree range thereby permitting the inner and outer components of the helmet 1100 to move relative to one another. As the displacement occurs, the connector strip 1116 and/or flexible connectors 1136, or in other embodiments, any combination of the springs, the flexible connectors or the connector strip, stretch to diffuse the energy of the impact, and subsequently pull the inner and outer components back into their original positions. Unlike current helmets, helmet 1100 may translate the energy from the force of an impact into relative motion of the inner and outer components, rather than attempting to absorb the energy with the wearer still receiving energy from the impact.

In some embodiments, the previously described components, e.g., connector strip 1116, flexible connectors 1136, compression mounts 814, concave member 1104, convex member 1102, etc., may be retro-fit into a helmet. For example, football helmets may be returned to the manufacturer for refurbishment and then returned to the user. A helmet may be retro-fit with any combination of the above-described components during refurbishment. In another embodiment, a user may add any combination of the above-described components to a helmet.

It should be understood, of course, that the foregoing relates to exemplary embodiments of the invention and that modifications may be made without departing from the spirit and scope of the invention as set forth in the following claims.

What is claimed is:

1. A helmet comprising:

an inner component adapted to cover the head of a wearer, the inner component having an inner surface and an outer surface:

a concave member disposed on the outer surface of the inner component and fixedly joined to the outer surface of the inner component;

an outer component adapted to cover the inner component, the outer component having an inner surface and an outer surface;

a convex member disposed on the inner surface of the outer component and fixedly joined to the inner surface of the outer component, wherein the convex member is adapted to fit inside the concave member;

one or more connectors disposed between the outer surface of the inner component and the inner surface of the outer component and fixedly joined to the respective surfaces; and an elastomeric tube having a first wing projecting tangentially from the tube and a second wing projecting tangentially from the tube, wherein the first wing is joined to the outer surface of the inner helmet and the second wing is joined to the inner surface of the outer helmet.

2. The helmet of claim 1, wherein the inner component and the outer component are formed of at least one of a hard plastic, fiberglass, or carbon fiber.

3. The helmet of claim 1, wherein the concave member and the convex member comprise at least one of a metal, a rigid plastic, or a ceramic.

4. The helmet of claim 1, wherein the convex member comprises at least one of a conical or frusto-conical protrusion configured to rest in an area of the same shape defined by the concave member.

5. The helmet of claim 4, wherein the convex member is configured to laterally shift within the concave member upon an impact to the outer component of the helmet.

6. The helmet of claim 1, further comprising a connector strip fixedly joined to the outer surface of the inner component and the inner surface of the outer component.

7. The helmet of claim 1, further comprising one or more foam pads disposed on the inner surface of the inner component.

8. The helmet of claim 1, further comprising a plurality of compression mounts joined to the inner component such that the inner surface of the outer component and the outer surface of the inner component define a uniform gap.

9. The helmet of claim 8, wherein the plurality of compression mounts are formed of an elastomer.

10. The helmet of claim 1, further comprising at least one foam strip disposed between the inner component and the outer component.

11. A helmet comprising:

an inner component adapted to cover the head of a wearer, the inner component having an inner surface and an outer surface:

a convex member disposed on the outer surface of the inner component and fixedly joined to the outer surface of the inner component;

an outer component adapted to cover the inner component, the outer component having an inner surface and an outer surface;

a concave member disposed on the inner surface of the outer component and fixedly joined to the inner surface of the outer component, wherein the concave member is adapted to fit around the convex member;

one or more connectors disposed between the outer surface of the inner component and the inner surface of the outer component and fixedly joined to the respective surfaces; and an elastomeric tube having a first wing projecting tangentially from the tube and a second wing projecting tangentially from the tube, wherein the first wing is joined to the outer surface of the inner helmet and the second wing is joined to the inner surface of the outer helmet.

* * * * *